US007335171B2

(12) United States Patent
Ewell et al.

(10) Patent No.: US 7,335,171 B2
(45) Date of Patent: Feb. 26, 2008

(54) THERMAL CANE

(76) Inventors: Derek Marlow Ewell, 11349 NE. Glisan, Portland, OR (US) 97220; Jenny Diane Watters, 11349 NE. Glisan, Portland, OR (US) 97220

( * ) Notice: Subject to any disclaimer, the term of this patent is extended or adjusted under 35 U.S.C. 154(b) by 0 days.

(21) Appl. No.: 11/732,868

(22) Filed: Apr. 4, 2007

(65) Prior Publication Data

US 2007/0239086 A1 Oct. 11, 2007

(51) Int. Cl.
*A61H 7/00* (2006.01)

(52) U.S. Cl. ..... 601/15; 601/135; 601/137

(58) Field of Classification Search ..... 601/15, 601/27, 39, 46, 71–73, 80, 118, 119, 125, 601/129, 133–137; 606/204; D24/211, 214, D24/215

See application file for complete search history.

(56) References Cited

U.S. PATENT DOCUMENTS

| | | | | |
|---|---|---|---|---|
| D317,204 | S * | 5/1991 | Henneseey | D24/211 |
| 5,730,708 | A * | 3/1998 | Spratt | 601/118 |
| 6,758,826 | B2 * | 7/2004 | Luettgen et al. | 601/73 |
| 6,988,997 | B2 * | 1/2006 | Stultz | 601/135 |

* cited by examiner

*Primary Examiner*—Quang D. Thanh
(74) *Attorney, Agent, or Firm*—Mark S. Hubert

(57) ABSTRACT

The present invention is a unique compact cane adapted to provide pain relief for the user. It has the ability to apply heat and pressure to constricted muscles anywhere on the body. This device employs removable microwavable massage handles that heat to an elevated temperature to relax muscles without burning the skin. The combination of heat and pressure has been proven to relax knotted muscles. The cane is hingeably foldable.

8 Claims, 3 Drawing Sheets

THERMAL CANE

BACKGROUND OF THE INVENTION

The present invention is a thermal cane and relates to a unique compact cane adapted to provide pain relief for the user. More particularly, the user of the cane will have the ability to apply heat and pressure to constricted muscles anywhere on the body. This device applies a new micowavable attachment that heats to a proper temperature to relax muscles without burning the skin. The combination of heat and pressure has been proven to relax knotted muscles.

The American populace is aging, therefore, there is an increased need for self-help related pain-relief devices. For example, the prolific sales of vibrating massagers demonstrate this fact. There are canes on the market that are designed to apply pressure to knotted muscles, but there are no canes known to us that utilize the novel and very useful component of removable massage handles that can be heated, which the thermal cane does. An additional novel component of the present invention is its portability. Thus the thermal cane has massage handles that are removable also the cane will have an appropriate hinge (or some other apparatus) that enables the cane to be folded in half or collapsed.

A recent study states that 18,899,000 persons or 9.3% of the population have used massages and 10,052,000 persons or 5% of the population have used massages in the past six months. With these statistics: in mind we believe that many persons in this population will need or desire some form of self-care to treat themselves when not getting professional treatment. In a United States survey on the use of complementary and alternative medicines, 10.9% of the total population utilized manipulative and body-based methods (which includes chiropractic and massage). We believe these individuals represent the first-adopters of self-help pain-relief devices.

Henceforth, the thermal cane would fulfill a long felt need in the health care/self-help industry. This new invention utilizes and combines known and new technologies in a unique and novel configuration to overcome the aforementioned problems and provide an effective means of relief for muscle pain.

SUMMARY OF THE INVENTION

The general purpose of the present invention, which will be described subsequently in greater detail, is to relieve pain that is common in knotted muscles. It has many of the advantages mentioned heretofore and many novel features that result in a new self-help health tool which is not anticipated, rendered obvious, suggested, or even implied by any of the prior art, either alone or in any combination thereof.

In accordance with the invention, an object of the present invention is to provide an improved pressure cane capable of relieving pain through pressure and heat, which is an excellent combination.

It is another object of this invention to provide a personal massage device with detachable massage handles that can be placed in a microwave wherein the handle stays cool while the massage ball absorbs the right amount of heat.

It is a further object of this invention to enable the user to utilize the detachable massage handles with or without heat as hand held devices.

It is a further object of this invention, to provide a personal massage device designed for portability and ease of travel packing.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
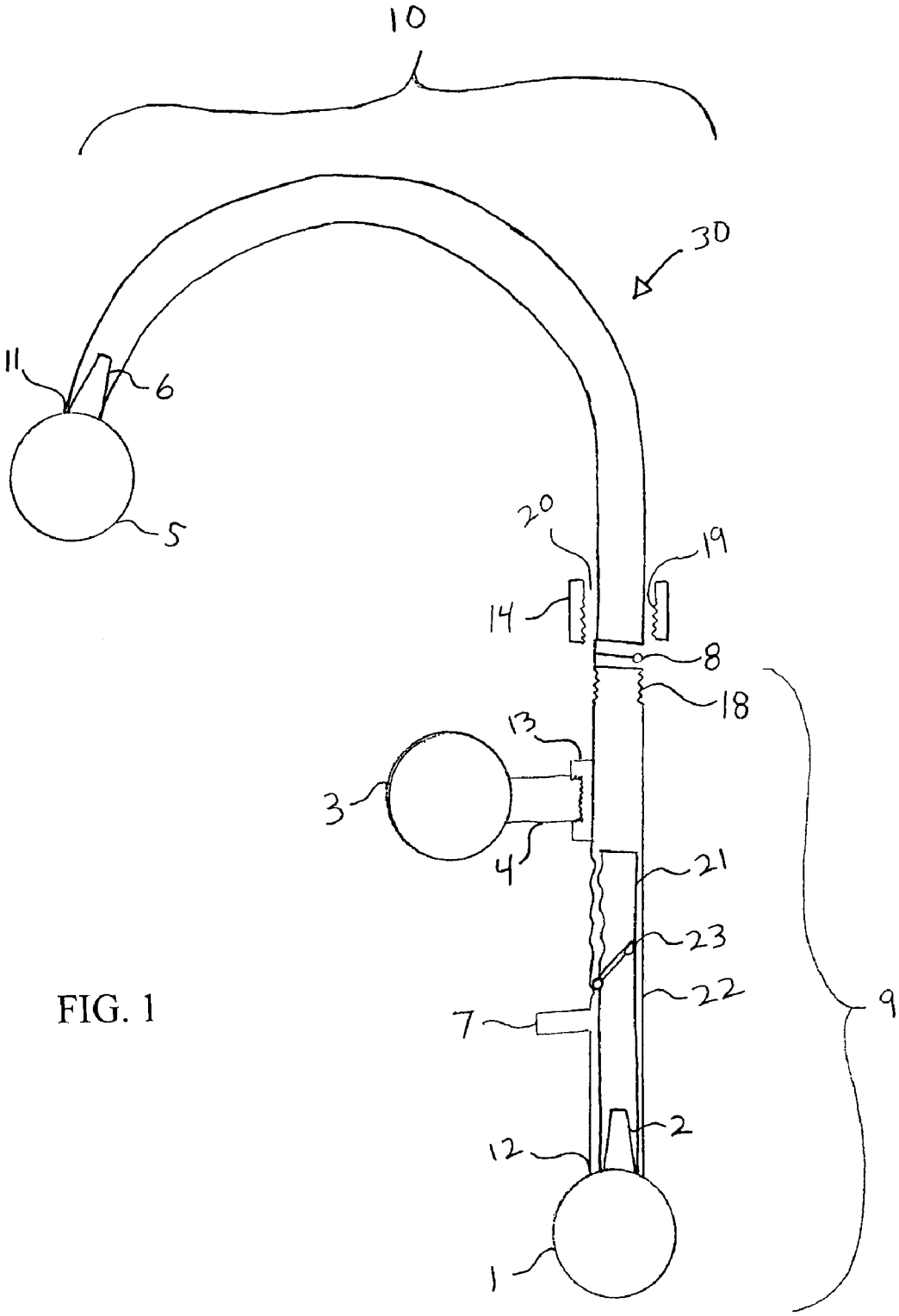
FIG. 1 is a cross-sectional view of the cane showing the general arrangement of all components.
Figure 2:
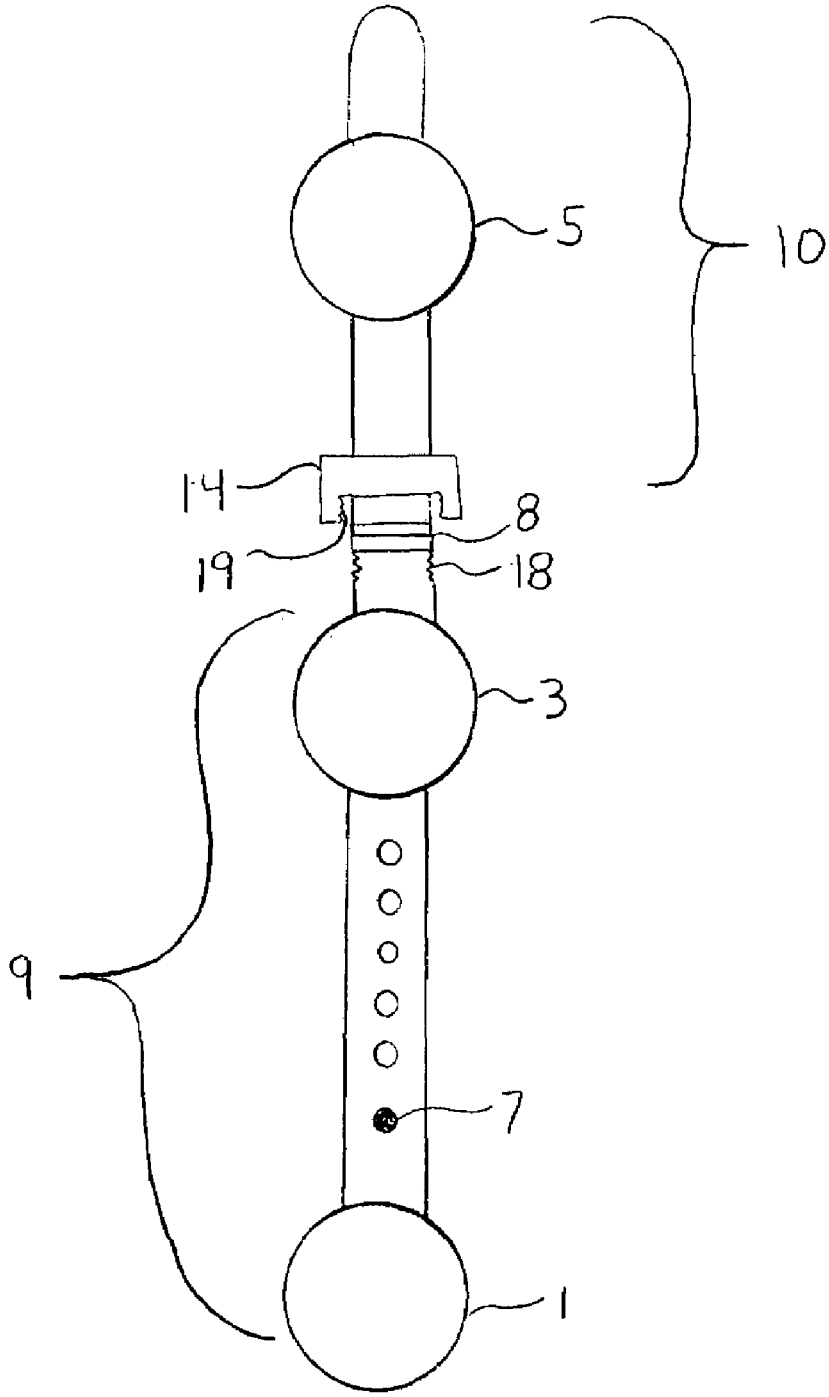
FIG. 2 is a front view of the cane.
Figure 3:
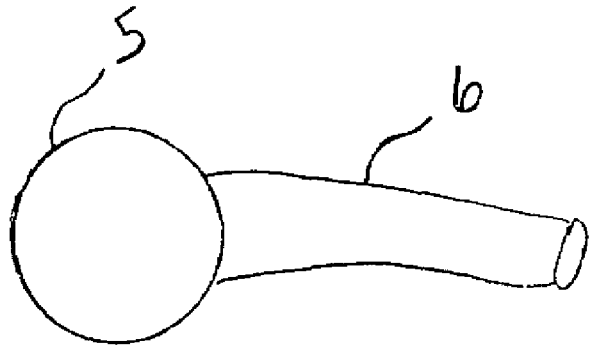
FIG. 3 is a side view of the removable heat sphere 5 and shaft 6.
Figure 4:
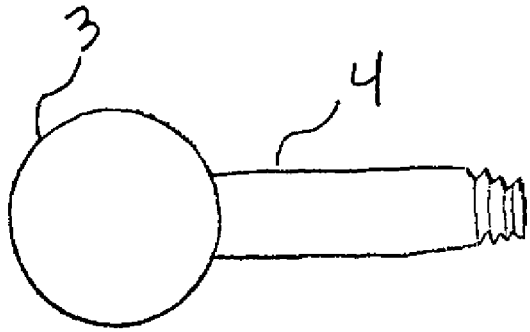
FIG. 4 is a side view of the removable heat sphere 3 and shaft 4.
Figure 5:
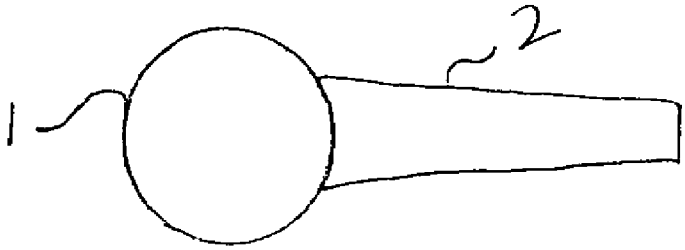
FIG. 5 is a side view of the removable heat sphere 1 and shaft 2.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit Looking at FIG. 1 it can be seen that the thermal cane 30 has a cane shaped tubular, resilient body having three removable spheres extending therefrom, between a distal end 12 and a proximate end 11 of the cane body. There is a first removable heat sphere 1, frictionally attached at the distal end 12, a second removable sphere 3, threading engaged with stub shaft 13 and a third removable heat sphere 5 frictionally attached at the proximate end 11. A mechanical hinging member 8 connects lower cane body 9 and upper cane body 10. This allows the cane to be folded for transport and storage.

On the lower cane body 9 adjacent the hinging member 8 lock threads 18 are formed. On the upper cane body 10 adjacent to the hinging member 8 a locking collar 14 resides. The locking collar has internal threads 19 that matingly conform to lock threads 18. The lock collar 14 has a central orifice formed therein 20 that allows sliding engagement of the lock collar about the upper cane body 10.

The lower body portion of the cane 9 is comprised of a first inner tube 21 and a second outer tube 22 one fitting inside of the other to provide telescopic extension to accommodate persons of different heights as is well known in the industry.

The inner tube 21 has a linear grouping of small orifices (approximately ¼" in diameter) that will align with matching orifices in the upper tube 22, which allows the cane to extend to various lengths. The inner tube 21 is locked into position relative to the outer tube 22 by extension of spring button 23 through the aligned orifices.

The outer tube 22 has a handle 7 and an internally threaded stub shaft 13 that extends normally therefrom.

The first sphere 1, second sphere 3, and third sphere 5 may be of the same or differing dimensions. The first sphere 1 and third sphere 5 have tapered shafts 2 and 6 extending therefrom. The tapered shafts are physically configured to frictionally engage the internal surfaces of the distal end 12 and proximal end 11 of the cane. The second sphere 3 has a straight shaft 4 threaded at one end to engage the threads of stub shaft 13. The material of sphere construction is a polymer or other material that is safely microwavable and designed to have a high coefficient of heat retention. Numerous sized spheres may be provided with the cane. The tapered shafts 2 and 6 and straight shaft 4 are made of a different polymer than the spheres 1, 3 & 5, (or other appropriate material) that has a small coefficient of thermal expansion and a low coefficient of microwave excitability.

The dimensions of the preferred embodiment cane body 3 are approximately 2' 6" long by ¾" in diameter. The curved end 10 (which is horseshoe shaped) curves back toward the main cane body 9 with about a foot of space between the cane body 9 and the curved proximate end 11. This spacing is designed to allow the user to reach any place on the user's back or any other hard-to-reach place on the body.

The three removable spheres 1, 3 & 5 with tapered shafts 2, 4 & 6 that can be detached (in an appropriate fashion) from the cane and placed in the microwave, heated up and reattached to the cane or used as hand-held devices. The first and second shafts 2 & 6 are a shaft and in the preferred embodiment are about 3½ inches long by ¾" with a slight therein taper. The massage sphere that is approximately 1¼" in diameter. The shaft is made of an appropriate material that will resist heat, specifically microwave heat, and the spheres 1, 3 & 5 are made of ceramic or other appropriate material that will absorb microwave heat.

The first removable massage sphere 1 is located at the proximate end 11 of the cane. The second removable massage sphere 4 is located approximately in the middle of the cane. The third removable massage sphere is located at the distal end 12 of the cane.

There is a handle 7 about 6" from the distal end 12 of the cane. This enables the user to grip the cane, hook it around a body part such as a shoulder and apply pressure to the appropriate area of the body.

Having thus described the invention, what is claimed as new and desired to be secured by Letters Patent is as follows:

1. A personal massage device comprised of:

an upper curved tubular member;

a lower linear tubular member;

a hinge;

a handle;

an internally threaded stub shaft;

a locking collar; and at least three removable massaging members;

wherein said upper member has a proximate end and a distal end and wherein said lower tubular member has a proximate end and a distal end and wherein said hinge is mechanically affixed to said distal end of said upper tubular member and said proximate end of lower tubular member so as to form hingeable cane shaped structure, and wherein a first heatable massaging member is frictionally affixed to said proximate end of the upper tubular member and wherein a second heatable massaging member is frictionally affixed to said distal end of the lower tubular member and wherein a third heatable massaging member is mechanically affixed to said stub shaft.

2. The massage device of claim 1 wherein said locking collar has a central recess therethrough sized to allow sliding movement about said upper curved tubular member and a set of threads formed on an internal surface thereof that threadingly engage a set of matingly conformed external threads formed on the proximate end said lower tubular member adjacent said hinge.

3. The massage device of claim 2 wherein said heatable massaging members are microwave heatable spheres with non-microwave heatable shafts extending normally therefrom.

4. The massage device of claim 3 wherein said first massaging member has a first shaft extending therefrom that is curved and tapered along a longitudinal axis of said shaft and sized so as to frictionally engage a first recess in said proximate end of said upper member.

5. The massage device of claim 4 wherein said second massaging member has a second linear shaft extending therefrom that is tapered along a longitudinal axis of said second shaft and sized so as to frictionally engage a second recess in said distal end of said lower member.

6. The massage device of claim 5 wherein said third massaging member has a third linear shaft extending therefrom that is externally threaded at one end so as to threadingly engage said stub shaft.

7. The massage device of claim 6 wherein said lower tubular member is a telescoping member having an outer tube and a slidingly engagable inner tube.

8. The massage device of claim 7 wherein said outer tube has a first linear array of orifices formed therethrough that align with a second linear array of orifices formed therethrough said inner tube and wherein a spring loaded button disposed wherein said assembly may extend therethough said first orifices and said second orifices and lock them relative to each other.

* * * * *